US011060765B2

(12) United States Patent
Meyer et al.

(10) Patent No.: US 11,060,765 B2
(45) **Date of Patent: *Jul. 13, 2021**

(54) ELECTRICAL RADIATOR TYPE HEATING APPLIANCE INCLUDING A VOLTAGE CONVERTER

(71) Applicant: LANCEY ENERGY STORAGE, Grenoble (FR)

(72) Inventors: Raphaël Meyer, Grenoble (FR); Gilles Moreau, Grenoble (FR); Antoine Romatier, Saint Vincent de Mercuze (FR)

(73) Assignee: LANCEY ENERGY STORAGE, Grenoble (FR)

( * ) Notice: Subject to any disclaimer, the term of this patent is extended or adjusted under 35 U.S.C. 154(b) by 0 days.

This patent is subject to a terminal disclaimer.

(21) Appl. No.: 16/464,047

(22) PCT Filed: Nov. 24, 2017

(86) PCT No.: PCT/FR2017/053243

§ 371 (c)(1),
(2) Date: May 24, 2019

(87) PCT Pub. No.: WO2018/096290

PCT Pub. Date: May 31, 2018

(65) Prior Publication Data

US 2019/0383519 A1 Dec. 19, 2019

(30) Foreign Application Priority Data

Nov. 24, 2016 (FR) ..... 16/61447

(51) Int. Cl.
*F24H 9/20* (2006.01)
*F24H 3/00* (2006.01)
(Continued)

(52) U.S. Cl.
CPC ..... *F24H 9/2071* (2013.01); *F24H 3/002* (2013.01); *F24H 9/02* (2013.01); *H05B 1/0277* (2013.01)

(58) Field of Classification Search
CPC ..... F24H 9/02; F24H 3/002; F24H 9/2071; F24H 2240/01; H05B 1/0277; H05B 1/0252; F24C 7/062
(Continued)

(56) References Cited

U.S. PATENT DOCUMENTS 6,037,571 A * 3/2000 Christopher ..... A47J 37/0709 219/450.1
6,142,143 A * 11/2000 Martin ..... F24B 1/1808 126/200
(Continued)

FOREIGN PATENT DOCUMENTS

CN 1567644 A 1/2005
CN 102695308 B 2/2015
(Continued)

OTHER PUBLICATIONS

International Search Report for Application No. PCT/FR2017/053243.
(Continued)

*Primary Examiner* — Eric S Stapleton
(74) *Attorney, Agent, or Firm* — Cantor Colburn LLP

(57) ABSTRACT

An electrical radiator type heating appliance comprises a case housing a heater member producing a first flow of calories (F1) when an input of the heater member is powered by a direct electric voltage. The heating appliance also comprises a voltage converter implanted in the case and comprising an input provided with connection elements for connecting the voltage converter to an electric power supply source and an output delivering a direct electric voltage
(Continued)

adapted to directly or indirectly power the input of the heater member.

13 Claims, 2 Drawing Sheets

(51) Int. Cl.
*F24H 9/02* (2006.01)
*H05B 1/02* (2006.01)

(58) Field of Classification Search
USPC ..... 392/375
See application file for complete search history.

(56) References Cited

U.S. PATENT DOCUMENTS 6,218,607 B1 * 4/2001 Mulligan ..... H02S 10/30 136/253
6,888,059 B2 * 5/2005 Murata ..... F23N 3/02 136/253
7,196,263 B2 * 3/2007 Fraas ..... F23C 3/002 136/244
7,358,463 B2 * 4/2008 Mizuno ..... H02M 7/4807 219/492
10,384,653 B2 * 8/2019 Shank ..... F24H 1/122
2003/0126775 A1 * 7/2003 Corry ..... F24C 7/004 40/428
2006/0090877 A1 * 5/2006 Hasegawa ..... H05K 7/20909 165/47
2007/0045286 A1 * 3/2007 Mizuno ..... H02M 7/4807 219/501
2007/0153560 A1 * 7/2007 Zhang ..... H02J 7/022 363/166
2007/0273214 A1 * 11/2007 Wang ..... H02J 5/00 307/72
2008/0067974 A1 * 3/2008 Zhang ..... B60L 53/63 320/104
2008/0238363 A1 * 10/2008 Bourilkov ..... H02J 7/0071 320/107
2009/0091291 A1 * 4/2009 Woody ..... H01M 10/48 320/109
2009/0310340 A1 * 12/2009 Betz ..... F24C 7/004 362/183
2010/0039062 A1 * 2/2010 Gu ..... B60L 53/65 320/101
2010/0301810 A1 * 12/2010 Biondo ..... B60L 53/60 320/155
2011/0286725 A1 * 11/2011 O'Toole ..... F24C 7/004 392/407
2012/0204374 A1 * 8/2012 Shank ..... B60S 1/482 15/250.01
2014/0167697 A1 * 6/2014 Stempin ..... B60L 53/22 320/109

FOREIGN PATENT DOCUMENTS

FR 2882132 A1 8/2006
FR 2978624 A1 2/2013
JP 544998 2/1993
JP 201499253 A 5/2014
KR 100704963 4/2007

OTHER PUBLICATIONS

Written Opinion for Application No. PCT/FR2017/053243.
English Machine Translation of Abstract FR2882132.
English Machine Translation of Abstract CN1567644.
English Machine Translation of Abstract CN102695308.
English Machine Translation to Abstract JP2014-99253.
English Machine Translation to Abstract JP544998.
English Machine Translation to KR100704963.
International Search Report for Application No. PCT/FR2017/053242.
Written Opinion for Application No. PCT/FR2017/053242.

* cited by examiner

ELECTRICAL RADIATOR TYPE HEATING APPLIANCE INCLUDING A VOLTAGE CONVERTER

CROSS REFERENCE TO RELATED APPLICATIONS

This application is a National Stage of PCT Application No. PCT/FR2017/053243 filed on Nov. 24, 2017, which claims priority to French Patent Application No. 16/61447 filed on Nov. 24, 2016, the contents each of which are incorporated herein by reference thereto.

TECHNICAL FIELD

The present invention concerns an electrical radiator type heating appliance, comprising a case housing a heater member producing a first flow of calories when an input of the heater member is powered by an electric voltage.

The invention also concerns an electrical installation comprising an electric power supply source and at least one such heating appliance.

BACKGROUND

Conventionally, the electric power supply source to which the heating appliance is connected delivers an alternating electric voltage and all components of the heating appliance are adapted accordingly. Conventionally, this power supply source is constituted by the local electrical network.

In some heating appliances, it is also known to integrate a set of batteries associated with the heater member. This set of batteries allows storing energy used by the heating appliance, to space out electricity consumption over time.

Nonetheless, these known heating appliances do not yet give complete satisfaction.

Indeed, they confer a very great limitation as to the nature of the electric power supply source, excluding the possibilities of operation via an electric power source delivering a direct electric voltage such as a photovoltaic equipment, a fuel cell, a supercapacitor or an electrochemical cells-based battery, except for generating yield losses that are unacceptable.

It is recalled that the conversion of a direct voltage into an alternating voltage and the reverse conversion induce very substantial yield losses.

Yet, it is known that the current trend promotes renewable energies which, most of the time, deliver a direct electric voltage.

BRIEF SUMMARY

The present invention aims at solving all or part of the drawbacks listed hereinabove.

In this context, there is a need to provide a simple, economical, reliable, high-efficiency heating appliance, which is much easier to use in the context of direct electric power supply sources while improving the overall yields.

To this end, there is proposed an electrical radiator type heating appliance, comprising a case housing a heater member producing a first flow of calories when an input of the heater member is powered by a direct electric voltage, the heating appliance comprising a voltage converter implanted in the case and comprising an input provided with connection elements for connecting the voltage converter to an electric power supply source and an output delivering a direct electric voltage adapted to directly or indirectly power the input of the heater member, a management unit housed within the case and controlling at least the heater member and a characterization element allowing characterizing the state-of-charge of the electrical energy storage device and transmission elements allowing addressing the value determined by the characterization element to an input of the management unit.

According to a particular embodiment, the voltage converter is configured so as to be able to deliver, at its output, said direct electric voltage by converting a direct electric voltage applied at the input of the voltage converter by the electric power supply source when the voltage converter is connected thereto.

According to another particular embodiment, the voltage converter is configured so as to be able to deliver, at its output, said direct electric voltage by converting an alternating electric voltage applied at the input of the voltage converter by the electric power supply source when the voltage converter is connected thereto.

According to yet another particular embodiment, the heating appliance comprises an electrical energy storage device operating under a direct electric current, having an input intended to be powered by a direct current and an output delivering a direct current, the electrical energy storage device comprising an electrochemical cells assembly-based battery and/or a supercapacitor and/or a fuel cell.

According to yet another particular embodiment, the heating appliance comprises:

- first linking elements for linking the output of the voltage converter with the input of the heater member and adapted to apply the direct electric voltage delivered at the output of the voltage converter to the input of the heater member;
- second linking elements for linking the output of the voltage converter with the input of the electrical energy storage device and adapted to apply the direct electric voltage delivered at the output of the voltage converter to the input of the electrical energy storage device,
- third linking elements for linking the output of the electrical energy storage device with the input of the heater member and adapted to apply the direct current delivered by the output of the electrical energy storage device to the input of the heater member,
- switch elements for toggling the first linking elements between an open circuit or closed circuit configuration, for toggling the second linking elements between an open circuit or closed circuit configuration, and for toggling the third linking elements between an open circuit or closed circuit configuration.

According to yet another particular embodiment, the management unit controls at least the switch elements.

According to yet another particular embodiment, the heating appliance comprises a measuring sensor for measuring the temperature outside the case and transmission elements allowing addressing the value determined by the measuring sensor to an input of the management unit.

According to yet another particular embodiment, the management unit ensures a control of the switch elements according to a predetermined strategy algorithm stored in a memory of the management unit, according to the value determined by the measuring sensor and addressed to the input of the management unit and according to the value determined by the characterization element and addressed to the input of the management unit.

According to yet another particular embodiment, the management unit makes the heating appliance toggle, by controlling the switch elements, between a first operating mode where the first linking elements and/or the third linking elements occupy an open circuit configuration and a second operating mode where the first linking elements and/or the third linking elements occupy a closed circuit configuration, the first operating mode being occupied if the difference between the value determined by the measuring sensor and a setpoint temperature known by the management unit is higher than a strictly positive first predetermined deviation and the second operating mode being occupied if the difference between the value determined by the measuring sensor and the setpoint temperature known by the management unit is lower than a second predetermined deviation less than or equal to zero.

According to yet another particular embodiment, the management unit makes the heating appliance toggle, by controlling the switch elements, between a third operating mode where the second linking elements occupy a closed circuit configuration and a fourth operating mode where the second linking elements occupy an open circuit configuration, the third operating mode being occupied if the value determined by the characterization element is lower than or equal to a first predetermined threshold known by the management unit and the fourth operating mode being occupied as soon as the value determined by the characterization element is higher than or equal to a second predetermined threshold known by the management unit and strictly higher than the first predetermined threshold.

According to yet another particular embodiment, the management unit makes the heating appliance occupy, by controlling the switch elements, a fifth operating mode where the third linking elements occupy a closed circuit configuration if the value determined by the characterization element is higher than or equal to a third predetermined threshold known by the management unit.

According to yet another particular embodiment, the management unit ensures a control of the voltage converter such that the direct electric voltage delivered at the output of the voltage converter varies according to the power to be delivered by the heater member which is calculated by the management unit.

According to yet another particular embodiment, the voltage converter comprises heat sinks producing a second flow of calories with the calories generated by the voltage converter and the second flow is mixed with the first flow of calories generated by the heater member.

There is also proposed an electrical installation comprising an electric power supply source and at least one such heating appliance whose connection elements of the input of the voltage converter are connected to the electric power supply source, in which the electric power supply source delivers a direct electric voltage and comprises all or part of the following elements: photovoltaic panels, a fuel cell, a supercapacitor, an electrochemical cells assembly-based battery.

BRIEF DESCRIPTION OF THE DRAWINGS

The invention will be better understood using the following description of particular embodiments of the invention provided as non-limiting examples and represented in the appended drawings, in which.

DETAILED DESCRIPTION

Figure 1:
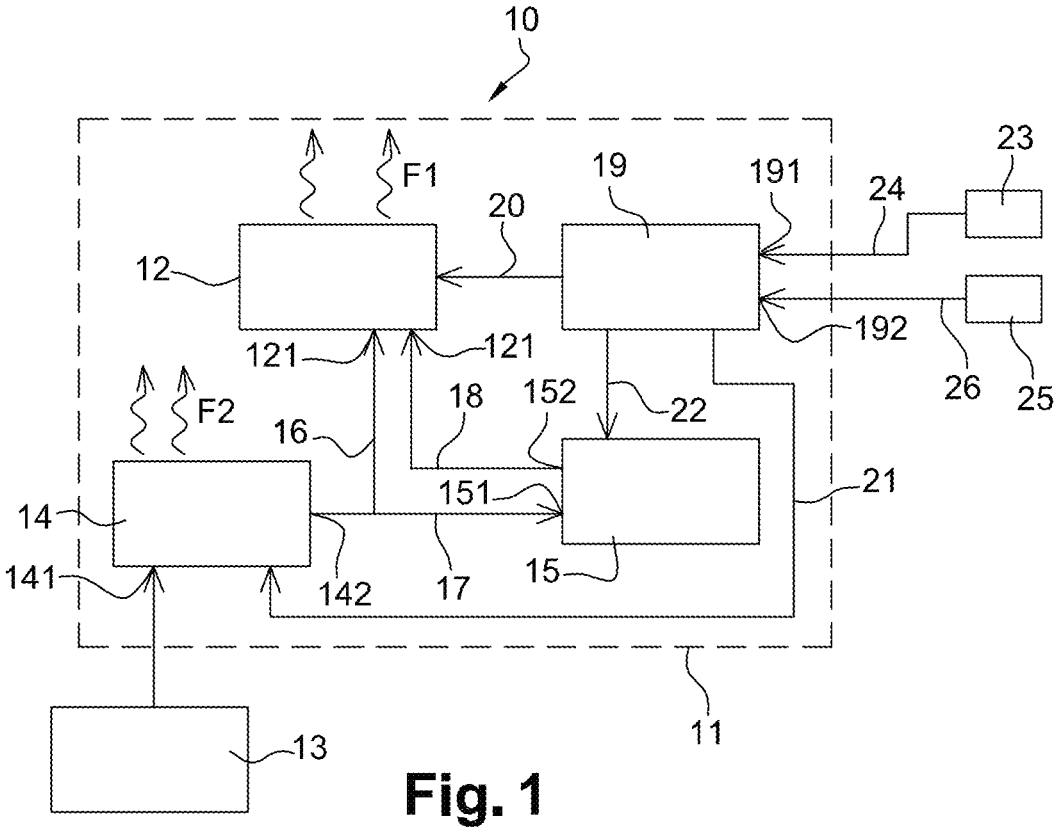
FIG. 1 is a schematic view of the components of an example of a heating appliance according to the invention.

Referring to the appended FIGS. 1 to 3 as summarized hereinabove, the invention essentially concerns an electrical radiator type heating appliance 10, comprising a case 11 housing a heater member 12 producing a first flow of calories F1 when an input 121 of the heater member 12 is powered by a direct electric voltage.

The heater member 12 may in particular comprise at least one radiating body and/or at least one heating device by a heat transfer fluid.

The invention also concerns an electrical installation comprising an electric power supply source 13 and at least one such heating appliance 10. As will be understood from the explanations that follow, the electric power supply source 13 may be of the type delivering an alternating electric voltage, or even more advantageously, be of the type delivering a direct electric voltage.

The heating appliance 10 comprises a voltage converter 14 implanted in the case 11 and comprising an input 141 provided with connection elements allowing electrically connecting the voltage converter 14 to the electric power supply source 13 and an output 142 delivering a direct electric voltage adapted to directly or indirectly power the input 121 of the heater member 12. The voltage converter 14 allows transforming the input current coming from the source 13 into a direct output current directly usable in this form by the components that the voltage converter 14 is intended to supply with energy.

The nature of the voltage converter 14 is directly related to that of the electric power supply source 13 to which it is intended to be connected. In particular, the voltage converter 14 may be configured so as to be able to deliver, at its output 142, the direct electric voltage by converting a direct electric voltage applied at the input 141 of the voltage converter 14 by the electric power supply source 13 when the voltage converter 14 is connected thereto. Thus, if the electric power supply source 13 is of the type delivering a direct electric voltage, then the voltage converter 14 may be of the DC/DC type. Alternatively, it is nonetheless still possible that the voltage converter 14 is configured so as to be able to deliver, at its output 142, the direct electric voltage by converting an alternating electric voltage applied at the input 141 of the voltage converter 14 by the electric power supply source 13 when the voltage converter 14 is connected thereto. Thus, if the electric power supply source 13 is of the type delivering an alternating electric voltage, then the voltage converter 14 may be of the AC/DC type.

The voltage converter 14 may for example comprise a switched-mode power supply or several switched-mode power supplies in parallel, or more simply at least one chopper, in order to enable the conversion of an alternating current into a direct current directly usable by the components that the output 142 of the voltage converter 14 is intended to supply with electrical energy.

According to an advantageous embodiment, the heating appliance 10 comprises an electrical energy storage device 15 operating under a direct electric current, having an input 151 intended to be powered by a direct current and an output 152 delivering another direct current. The storage device 15 allows storing the energy used by the heating appliance 10, in order to space out the consumption of electricity over time. In particular, it allows storing the electrical energy when it is available, in particular when its purchase cost is deemed to be economical.

As example, the electrical energy storage device 15 comprises an electrochemical cells assembly-based battery and/or a supercapacitor and/or a fuel cell.

Moreover, in order to be able to achieve a direct supply of the heater member 12 with electrical energy through the output 142 of the voltage converter 14, the heating appliance 10 comprises first linking elements 16 for linking the output 142 of the voltage converter 14 with the input 121 of the heater member 12 and adapted to apply the direct electric voltage delivered at the output 142 of the voltage converter 14 to the input 121 of the heater member 12.

In parallel, in order to be able to provide an indirect supply of the heater member 12 with electrical energy through the output 142 of the voltage converter 14, the heating appliance 10 comprises second linking elements 17 for linking the output 142 of the voltage converter 14 with the input 151 of the electrical energy storage device 15 and adapted to apply the direct electric voltage delivered at the output 142 of the voltage converter 14 to the input 151 of the electrical energy storage device 15. Complementarily, the heating appliance 10 comprises third linking elements 18 for linking the output 152 of the electrical energy storage device 15 with the input 121 of the heater member 12 and adapted to apply the direct current delivered by the output 152 of the electrical energy storage device 15 at the input 121 of the heater member 12.

The nature of the first linking elements 16, of the second linking elements 17 and of the third linking elements 18 is not limiting in itself as long as it enables them to be adapted to the functions assigned to them and which have been presented hereinbefore.

Furthermore, the heating appliance 10 comprises switch elements (not represented as such) for toggling the first linking elements 16 between an open circuit or closed circuit configuration, for toggling the second linking elements 17 between an open circuit or closed circuit configuration, and for toggling the third linking elements 18 between an open circuit or closed circuit configuration.

The heating appliance 10 also comprises a management unit 19 housed within the case 11 and controlling the heater member 12 via the control links 20 (wired or wireless links). The management unit 19 can also ensure control of the switch elements mentioned in the previous paragraph.

The management unit 19 can also ensure the control of the voltage converter 14 via the control links 21 (wired or wireless links) and/or the control of the electrical energy storage device 15 via the control links 22 (wired or wireless links).

In particular, the management unit 19 ensures a control of the voltage converter 14 such that the direct electric voltage delivered at the output 142 of the voltage converter 14 varies according to the power to be delivered by the heater member 12 calculated by the management unit 19. In particular, such a control strategy will be considered and facilitated when the voltage converter 14 comprises a plurality of switched-mode power supplies in parallel. It is therefore possible to vary the power delivered by the heater member 12 in a simple and economical way, without resorting to a complex electronic solution.

Thus, the direct voltage delivered by the voltage converter 14 is dependent on the voltage required for the heater member 12 or for the storage device 15.

The use of a voltage converter 14 of the switched-mode power supply or chopper type also allows avoiding redundancy between the direct current supplies of the different electronic components incorporated in the heating appliance 10 (control map, sensors, display, etc. . . . ). On the contrary, the voltage converter 14 allows powering with direct current all electronic components. The result is a simplicity of design, a limited cost, a better robustness.

It goes without saying that the output 142 of the voltage converter 14 is also linked to an input of the management unit 19 in order to ensure the supply with electrical energy.

As represented in FIG. 1, the heating appliance 10 also comprises a measuring sensor 23 adapted to measure the temperature outside the case 11 and transmission elements 24 26 allowing addressing the value determined by the measuring sensor 23 to an input 191 of the management unit 19.

The heating appliance 10 also comprises a characterization element 25 allowing characterizing the state-of-charge of the electrical energy storage device 15 and transmission elements 26 allowing addressing the value determined by the characterization element or characterizer 25 to an input 192 of the management unit 19.

Preferably, the management unit 19 ensures a control of the switch elements according to a predetermined strategy algorithm stored in a memory of the management unit 19, according to the value determined by the measuring sensor 23 and addressed to the input 191 of the management unit 191 via the first transmission elements 24 and according to the value determined by the characterization element 25 and addressed to the input 192 of the management unit 19 via the second transmission elements 26.

The strategy algorithm allows choosing the best conditions for choosing the operation of the heater member 12, the direct charging of the storage device 15 with direct current or the discharge of the storage device 15 through the heater member 12 adapted for direct current.

According to a preferred embodiment, the management unit 19 makes the heating appliance 10 toggle, by controlling the switch elements, between:

- a first operating mode where the first linking elements 16 and/or the third linking elements 18 occupy an open circuit configuration, the first operating mode being occupied if the difference between the value determined by the measuring sensor 23 and a setpoint temperature known by the management unit 19 is higher than a strictly positive first predetermined deviation,
- and a second operating mode where the first linking elements 16 and/or the third linking elements 18 occupy a closed circuit configuration, the second operating mode being occupied if the difference between the value determined by the measuring sensor 23 and the setpoint temperature known by the management unit 19 is lower than a second predetermined deviation less than or equal to zero.

The value of the first predetermined deviation is typically comprised between 1 and 3°, for example equal to 2°. Thus, in the latter example, the first operating mode is adopted if the temperature measured by the temperature sensor 23 is at least two degrees higher than the setpoint temperature, which has the effect of stopping the operation of the heater member 12.

The value of the second predetermined deviation is typically comprised between −1 and 0, for example equal to 0. Thus, in the latter example, the second operating mode is adopted if the temperature measured by the temperature sensor 23 is lower than or equal to the setpoint temperature, which has the effect of starting heating of the room by the heater member 12.

Moreover, parallel to these control strategies already described in connection with the first and second operating modes, the management unit 19 makes the heating appliance 10 toggle, by controlling the switch elements, between:

- a third operating mode where the second linking elements 17 occupy a closed circuit configuration, the third operating mode being occupied if the value determined by the characterization element 25 is lower than or equal to a first predetermined threshold known by the management unit 19, and a fourth operating mode where the second linking elements 17 occupy an open circuit configuration, the fourth operating mode being occupied as soon as the value determined by the characterization element is higher than or equal to a second predetermined threshold known by the management unit 19 and strictly higher than the first predetermined threshold.

Parallel to these control strategies already described in connection with the first, second, third and fourth operating modes, the management unit 19 makes the heating appliance 10 occupy, by controlling the switch elements, a fifth operating mode where the third linking elements 18 occupy a closed circuit configuration if the value determined by the characterization element 25 is higher than or equal to a third predetermined threshold known by the management unit 19. In particular, the third predetermined threshold is comprised between the first predetermined threshold and the second predetermined threshold.

Typically, the first predetermined threshold is for example equal to 0.15. Thus, the third operating mode is adopted if the state-of-charge of the storage device 15 is less than 15%, which has the effect of starting the charging of the storage device 15 in order to avoid an excessive discharge likely to degrade the storage device 15. Alternatively or in combination with the foregoing, the adoption of the third operating mode may possibly be conditioned by the presence of inexpensive energy from the source 13.

In turn, the second predetermined threshold is typically greater than 0.9, for example equal to 0.95. Thus, the fourth operating mode is adopted if the state-of-charge of the storage device 15 is greater than 95%, which has the effect of stopping the charging of the storage device 15 in order to avoid an excessive charging and a premature wear.

In turn, the third predetermined threshold is typically comprised between 0.4 and 0.6, for example equal to 0.5. Thus, the fifth operating mode is adopted if the state-of-charge of the storage device 15 is greater than 50% for example, which has the effect of starting the electric power supply of the heater member 12 from the storage device 15. Alternatively, or in combination with the foregoing, the adoption of the fifth mode operation may possibly be conditioned by the absence of cheap energy from the source 13.

The reader should understand that the use of the terms "first operating mode", "second operating mode", "third operating mode", "fourth operating mode" and "fifth operating mode" does not confer to them any priority property of one relative to the other and any exclusion property of one relative to the other. On the contrary, it is quite possible to combine together different operating modes.

The term "state-of-charge" evokes a magnitude totally known to those skilled in the art. There are many ways to evaluate this state-of-charge, providing no limitation herein.

Advantageously, the voltage converter 14 comprises heat sinks producing a second flow of calories F2 with the calories generated by the voltage converter 14. The inner organization of the heating appliance 10 is such that the second flow F2 is mixed with the first flow of calories F1 generated by the heater member 12. The second flow F2 serves both to rapid preheating of the other components and, by mixing with the first flow F1, allows optimizing the energy efficiency of the electrical appliance 10 by avoiding the calories produced by the voltage converter 14 being lost or even annoying. In other words, the heat generated by the voltage converter 14 for transforming the input current into direct current is used for the heating of the components and the generation of heat by the appliance 10 to avoid yield losses.

Now, within the electrical installation, the connection elements of the input 141 of the voltage converter 14 are connected to the electric power supply source 13. Quite preferably, the electric power supply source 13 delivers a direct electric voltage and comprises all or part of the following elements: photovoltaic panels, a fuel cell, a supercapacitor, an electrochemical cells assembly-based battery. This allows optimizing the overall efficiency of the heating appliance 10 and of the electrical installation avoiding losses conventionally due to the conversions of an alternating current into a direct current. Furthermore, the heating appliance 10 is directly usable by power supply from a direct current source, which is a current trend in particular because of the development of renewable energies.

Figure 2:
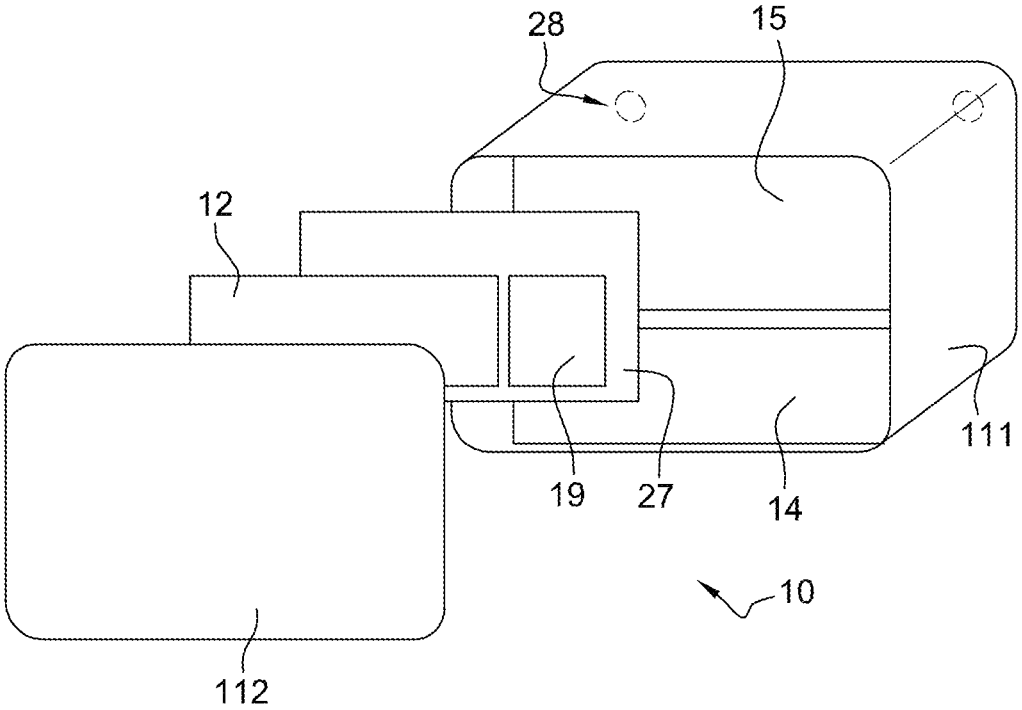
FIGS. 2 and 3 illustrate two embodiments of the heating appliance of FIG. 1.
Figure 3:
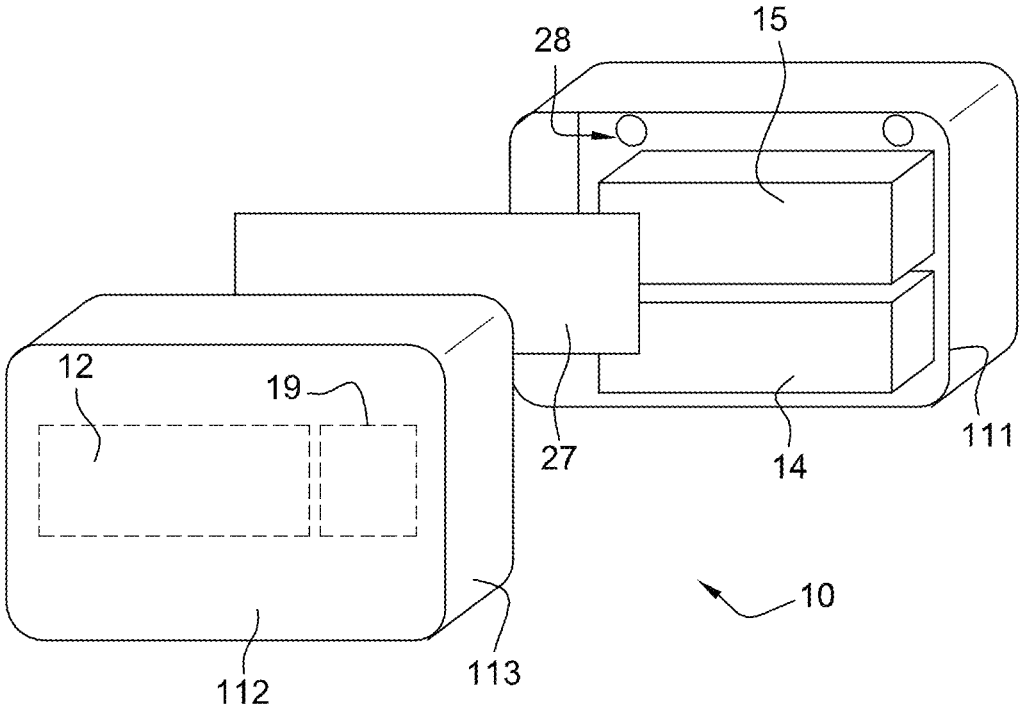

Referring now to FIGS. 2 and 3, the case 11 may comprise a rear portion 111 comprising fastening means 18 allowing fastening the case 11 to a partition, for example a vertical partition such as a wall, and a front railing 112 enabling the radiation of the flows F1 and F2 towards the outside of the case 11. In the variant of FIG. 2, the rear portion 111 has a thickness substantially equal to the total thickness of the case 11 and the front railing 112 closes the case 11 at the level of the front peripheral contour of the rear portion 111. In the variant of FIG. 3, the rear portion 111 has a thickness smaller than the total thickness of the case 11 and the case 11 also comprises a front portion 113 supporting the front railing 112 in its front area and brought to close, in its rear area, the case 11 at the level of the front peripheral contour of the rear portion 111.

Within the case 11, the storage device 15 is located above the voltage converter 14 and this first assembly is shifted rearwardly relative to a second assembly formed by the heater member 12 and the management unit 19 disposed side-by-side. A heat-insulating partition 27 separates the first assembly and the second assembly, depending on the thickness of the case 11, only at the level of the storage device 15. On the contrary, the insulating partition 27 is not arranged between the voltage converter 14 and the second assembly. As a result, the calories generated by the voltage converter 14 during the voltage conversion are mixed with the calories generated by the heater member 12 and allows preheating, at cold, at least the management unit 19, the storage device 15 and the heater member 12.

The provision of a heating appliance 10 operating with a direct current and incorporating the voltage converter 14 allows choosing the voltage upstream and inside the heating appliance 10. With the solutions known to date, there is no possibility to directly use and control a direct voltage source. On the contrary, the heating appliance 10 allows controlling the type of electricity and choosing the nature of the power supply source 13 and the heater member 12 type and consequently allows participating in the integration of renewable energies sources on the electrical network while avoiding the losses of transformation into alternating current. Indeed, the heating appliance 10 can be directly used by power supply via a direct voltage source, without the need for conversion into alternating current, thereby avoiding the losses that would result therefrom.

The passage from the alternating or direct input voltage into a direct voltage via the voltage converter 14, typically limited between 12 and 60 V, allows limiting effectively people safety issues.

Besides the advantages that have been previously disclosed, the solution that is the object of the invention is simple, economical, reliable, has a high efficiency and its use in the context of direct electric power supply sources is clearly facilitated while improving the overall yields.

This solution can be integrated within smart grids to enable optimal storage of energies of direct voltage sources on the electrical network.

Advantageously, the management unit 19 of the heating appliance 10 can be controlled in accordance with the events of the home network or of the mains network to compensate for the following cases encountered in «smart grids»: production in excess to the demand, demand in excess to the production and extraction of reactive power.

In case of a production larger than the demand, the storage device 15 can consume energy on the domestic or mains network for local storage.

In case of a demand larger than the production, the storage device 15 can supply energy to the domestic or mains network.

In case of a reactive power extraction, the storage device 15 can be used, with the appropriate voltage and phase parameters, to increase the power factor and/or to reduce the harmonic pollution of the network.

For example, solar energy sources, fuel cells, supercapacitors and electrochemical batteries are sources of direct voltage which may be an energy source connected to the heating appliance 10 and these sources having high direct voltage levels, the DC/DC type voltage converter 14 will enable a use in the heating appliance 10 under optimal conditions. Advantageously, this solution can be integrated within plus-energy housings to enable in situ storage of renewable energies originating from the production of the plus-energy housing.

Of course, the invention is not limited to the embodiments that are represented and described hereinabove, but covers, on the contrary, all variants thereof.

The invention claimed is:

1. An electrical radiator type heating appliance, comprising:

a case housing a heater member, the heater member producing a first flow of calories when an input of the heater member is powered by a direct electric voltage;

a voltage converter implanted in the case, an input of the voltage converter being configured to be operably coupled to an electric power supply source and an output of the voltage converter being operably coupled to the input of the heater member;

an electrical energy storage device operating under a direct electric current, the electrical energy storage having an input powered by a direct current and an output delivering a direct current, the electrical energy storage device being operably coupled to the heater member and the voltage converter;

a management unit housed within the case and controlling at least the heater member;

a characterizer operably coupled to the management unit, the characterizer providing an input corresponding to a state-of-charge of the electrical energy storage device to the management unit;

a measuring sensor operably coupled to the management unit, the measuring sensor providing an input corresponding to a temperature outside the case to the management unit; and wherein the management unit, according to a predetermined strategy algorithm stored in a memory of the management unit, operates the heater member according to the input corresponding to the state-of-charge of the electrical energy storage device and the input corresponding to the temperature outside the case.

2. The heating appliance according to claim 1, wherein the voltage converter is configured to deliver, at its output, the direct electric voltage by converting a direct electric voltage applied at the input of the voltage converter by the electric power supply source when the voltage converter is connected to the electric power supply source.

3. The heating appliance according to claim 1, wherein the voltage converter is configured to deliver, at its output, the direct electric voltage by converting an alternating electric voltage applied at the input of the voltage converter by the electric power supply source when the voltage converter is connected to the electric power supply source.

4. The heating appliance according to claim 1, wherein the electrical energy storage device comprises at least one of the following: an electrochemical cells assembly-based battery; a supercapacitor; and a fuel cell.

5. The heating appliance according to claim 4, wherein the heating appliance comprises:

first linking elements linking the output of the voltage converter with the input of the heater member, second linking elements linking the output of the voltage converter with the input of the electrical energy storage device, third linking elements linking the output of the electrical energy storage device with the input of the heater member, wherein the first linking elements, the second linking elements and the third linking elements are configured to transition between an open circuit configuration and a closed circuit configuration.

6. The heating appliance according to claim 5, wherein the management unit transitions the first linking elements, the second linking elements and the third linking elements between the open circuit configuration and the closed circuit configuration.

7. The heating appliance according to claim 1, wherein the management unit controls the voltage converter such that a direct electric voltage delivered at the output of the voltage converter varies according to a power to be delivered by the heater member calculated by the management unit.

8. The heating appliance according to claim 1, wherein the voltage converter includes heat sinks that produce a second flow of calories, the second flow of calories being generated by the voltage converter and wherein the second flow of calories is mixed with the first flow of calories produced by the heater member.

9. An electrical installation comprising an electric power supply source and at least one heating appliance according to claim 1, the voltage converter being operably coupled to the electric power supply source, wherein the electric power supply source delivers a direct electric voltage and comprises at least one of the following elements: photovoltaic panels, a fuel cell, a supercapacitor, an electrochemical cells assembly-based battery.

10. An electrical radiator type heating appliance, comprising:

a case housing a heater member, the heater member producing a first flow of calories when an input of the heater member is powered by a direct electric voltage;

a voltage converter located in the case, an input of the voltage converter being configured to be operably coupled to an electric power supply source and an output of the voltage converter being operably coupled to the input of the heater member;

an electrical energy storage device operating under a direct electric current, the electrical energy storage device having an input powered by a direct current and an output delivering a direct current, the electrical energy storage device comprising at least one of the following; an electrochemical cells assembly-based battery, a supercapacitor, and a fuel cell;

a management unit housed within the case and controlling at least the heater member;

a characterizer operably coupled to the management unit, the characterizer providing an input corresponding to a state-of-charge of the electrical energy storage device to the management unit;

first linking elements linking the output of the voltage converter with the input of the heater member;

second linking elements linking the output of the voltage converter with the input of the electrical energy storage device;

third linking elements for linking the output of the electrical energy storage device with the input of the heater member wherein the first linking elements, the second linking elements and the third linking elements are configured to transition between an open circuit configuration and a closed circuit configuration;

a measuring sensor operably coupled to the management unit, the measuring sensor providing an input corresponding to a temperature outside the case to the management unit; and wherein the management unit, according to a predetermined strategy algorithm stored in a memory of the management unit, operates the heater member according to the input corresponding to the state-of-charge of the electrical energy storage device and the input corresponding to the temperature outside the case, and wherein the management unit causes the first linking elements, the second linking elements and the third linking elements to transition between the open circuit configuration and the closed circuit configuration.

11. The heating apparatus according to claim 10, wherein the management unit causes the heating appliance to be in one of: a first operating mode where the first linking elements and/or the third linking elements are in the open circuit configuration, and a second operating mode where the first linking elements and/or the third linking elements are in the closed circuit configuration, the heating appliance being placed into the first operating mode being by the management unit when a difference between a value determined by the measuring sensor corresponding to a temperature outside the case and a setpoint temperature stored in the management unit is higher than a positive first predetermined deviation and wherein the heating appliance is placed into the second operating mode if a difference between a value determined by the measuring sensor corresponding to a temperature outside the case and the setpoint temperature stored in the management unit is lower than a second predetermined deviation that is less than or equal to zero.

12. The heating appliance according to claim 10, wherein the management unit causes the heating appliance to be in one a third operating mode where the second linking elements are in the closed circuit configuration and a fourth operating mode where the second linking elements are in the open circuit configuration, the heating appliance being placed into the third operating mode by the management unit if the input corresponding to the state-of-charge of the electrical energy storage device is lower than or equal to a first predetermined threshold stored in the management unit and the heating appliance being placed into the fourth operating mode by the management unit when the input corresponding to the state-of-charge of the electrical energy storage device is higher than or equal to a second predetermined threshold stored in the management unit and higher than the first predetermined threshold.

13. The heating appliance according to claim 10, wherein the management unit causes the heating appliance occupy to be in a fifth operating mode where the third linking elements are in the closed circuit configuration if the input corresponding to the state-of-charge of the electrical energy storage device is higher than or equal to a third predetermined threshold stored in the management unit.

* * * * *